US005478710A

United States Patent [19]

Müller et al.

[11] Patent Number: 5,478,710

[45] Date of Patent: Dec. 26, 1995

[54] TYPE OF POLYMER LATEX AND ITS USE AS PLASTICIZER IN A PHOTOGRAPHIC MATERIAL

[75] Inventors: Michael Müller, Bergisch Gladbach; Daniel M. Timmerman, Mortsel; Guido V. Desie, Herent; Stefaan F. Lingier, Evergem; Günter Stackmann, Leverkusen, all of Germany

[73] Assignee: AGFA-Gevaert, N.V., Mortsel, Belgium

[21] Appl. No.: 289,638

[22] Filed: Aug. 12, 1994

[30] Foreign Application Priority Data

Sep. 9, 1993 [DE] Germany ..... 93202629.7

[51] Int. Cl.[6] ..... G03C 1/76

[52] U.S. Cl. ..... 430/536; 430/631; 430/537; 430/627; 430/640; 430/539

[58] Field of Search ..... 430/631, 536, 430/537, 627, 640, 539

[56] References Cited

U.S. PATENT DOCUMENTS

| | | | |
|---|---|---|---|
| 4,151,336 | 4/1979 | Sackmann et al. | 526/15 |
| 4,256,827 | 3/1981 | Noguchi et al. | 430/215 |
| 4,481,319 | 11/1984 | Sackmann et al. | 524/213 |
| 4,714,671 | 12/1987 | Helling et al. | 430/545 |
| 4,931,510 | 6/1990 | Sackmann et al. | 525/302 |
| 5,013,794 | 5/1991 | Sackmann et al. | 525/203 |

FOREIGN PATENT DOCUMENTS 0307778 3/1989 European Pat. Off. .

*Primary Examiner*—Thomas R. Neville
*Attorney, Agent, or Firm*—Breiner & Breiner

[57] ABSTRACT

New types of polymer latices and their use in photographic materials are disclosed. They are obtained by subjecting to radical emulsion polymerisation one or more radical-polymerisable monomers, whose emulsifier-free homopolymers or copolymers possess a glass transition temperature below 65° C., preferably below 30° C., in the presence of a water-soluble polymer of a particular chemical formula.

These new types of latices are preferably used in graphic arts contact materials, e.g. daylight materials. They can be used in relative high amounts thus improving dimensional stability without deteriorating the scratch resistance too strongly.

A preferred radical-polymerisable monomer mixture comprises n.-butyl acrylate, methyl methacrylate and acrylic acid.

7 Claims, 9 Drawing Sheets

TYPE OF POLYMER LATEX AND ITS USE AS PLASTICIZER IN A PHOTOGRAPHIC MATERIAL

DESCRIPTION

1. Field of the Invention

Figure 1:
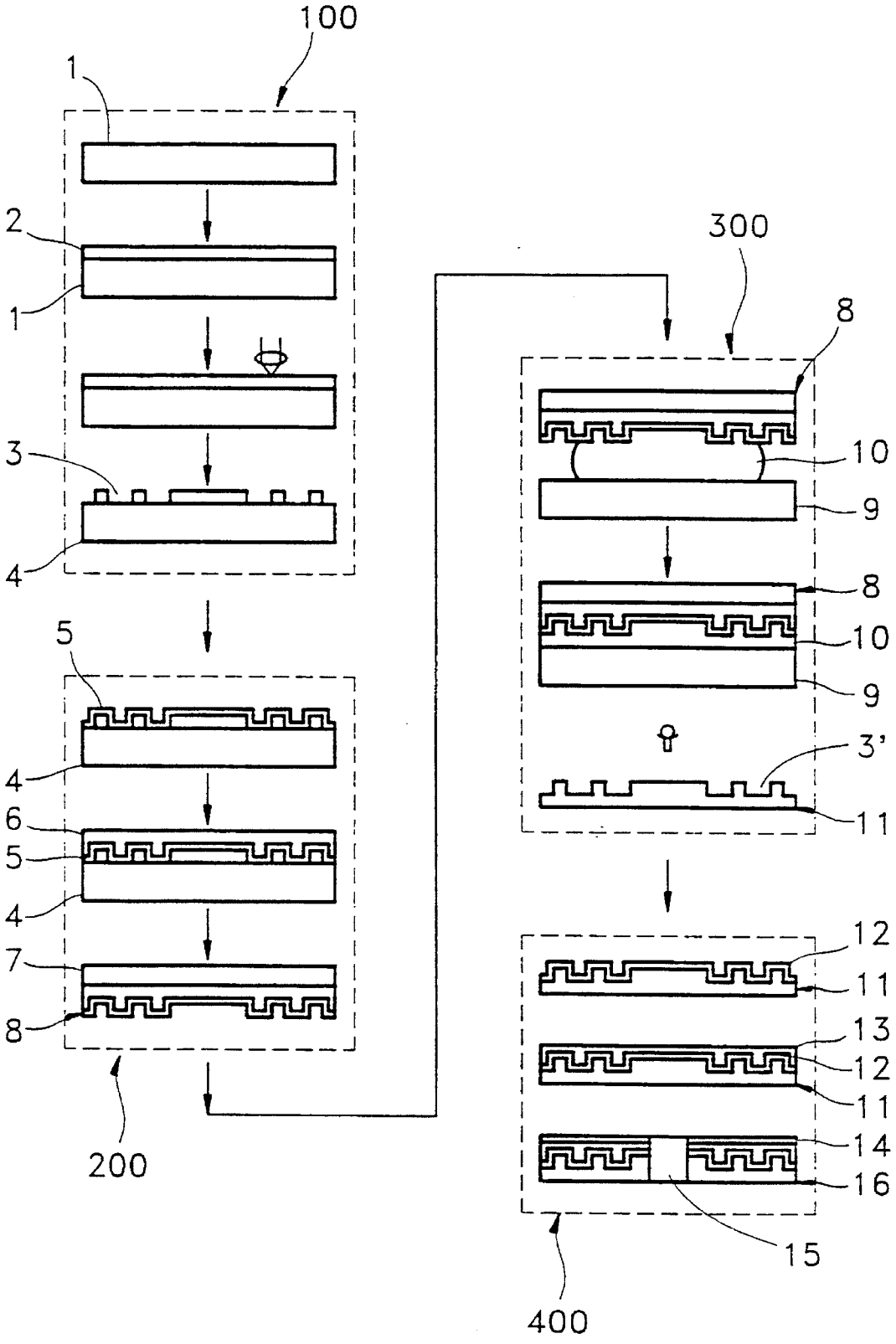
FIG. 1 PRIOR ART
Figure 2A:
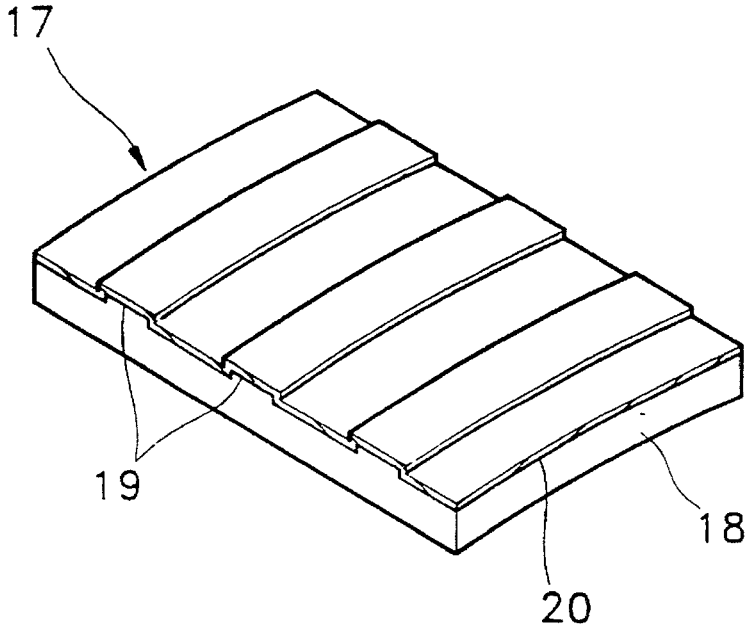
Figure 2B:
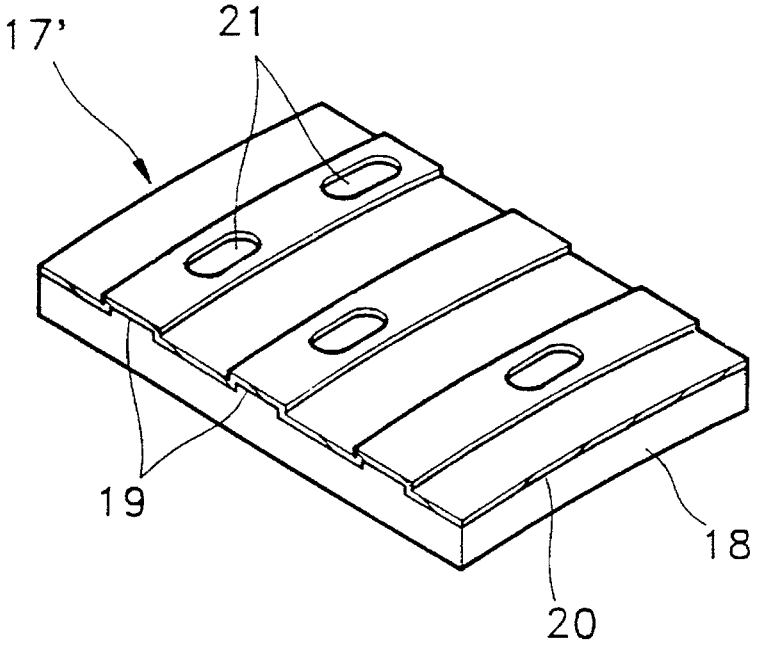
Figure 3:
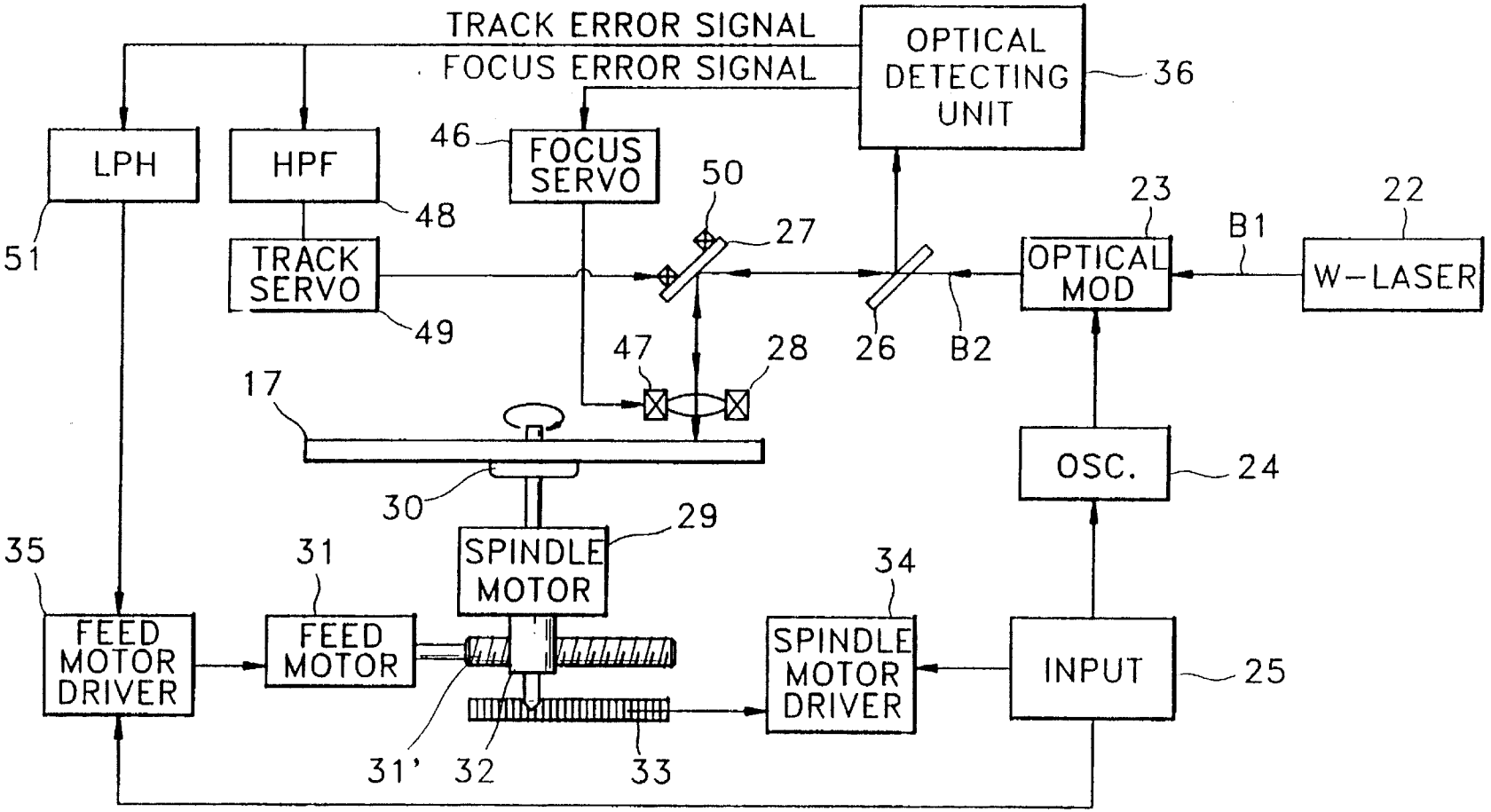
Figure 4:
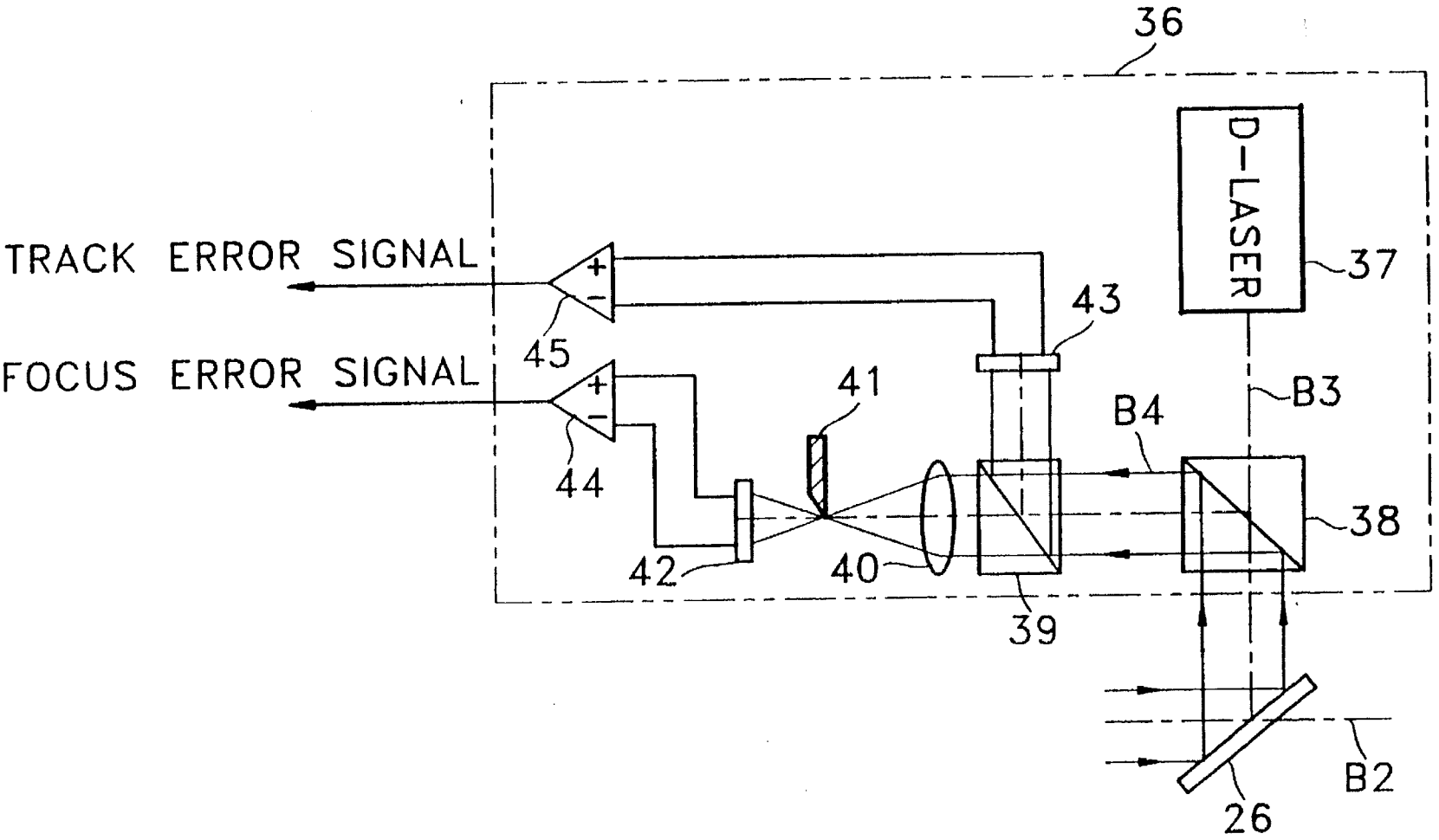
Figure 5A:
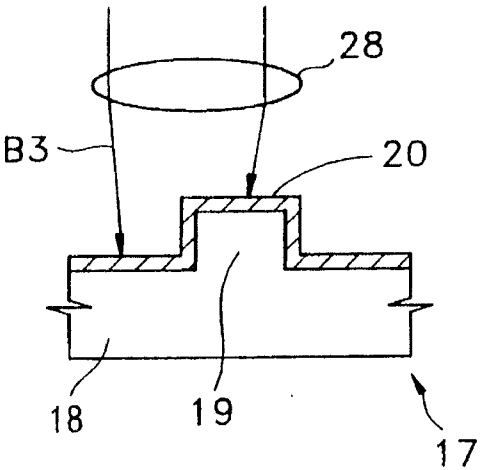
Figure 5B:
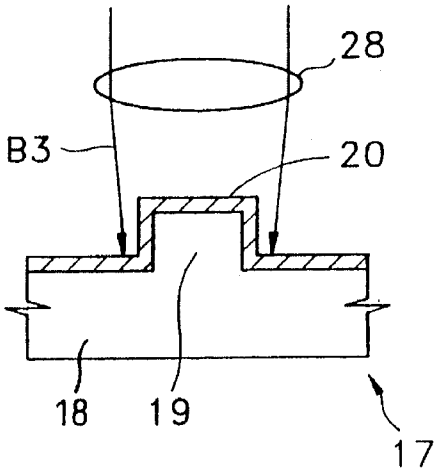
Figure 5C:
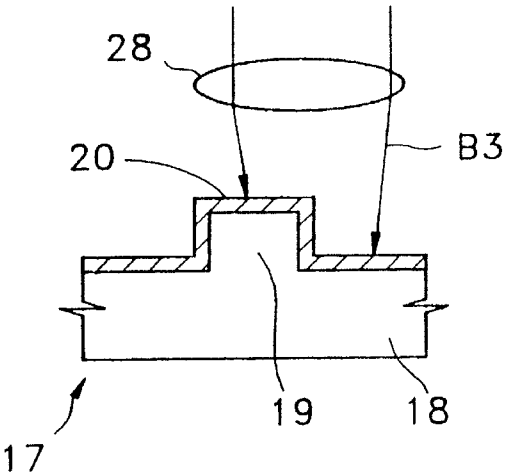
Figure 6A:
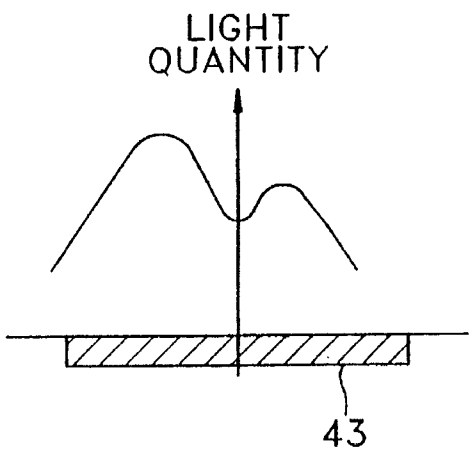
Figure 6B:
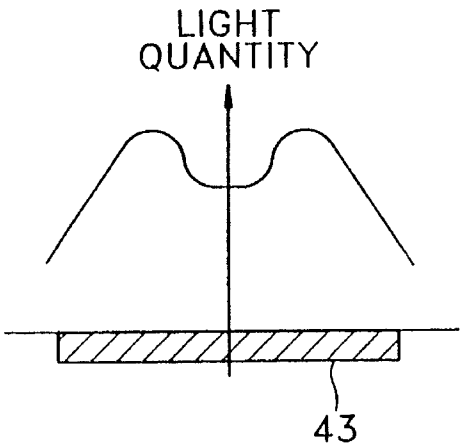
Figure 6C:
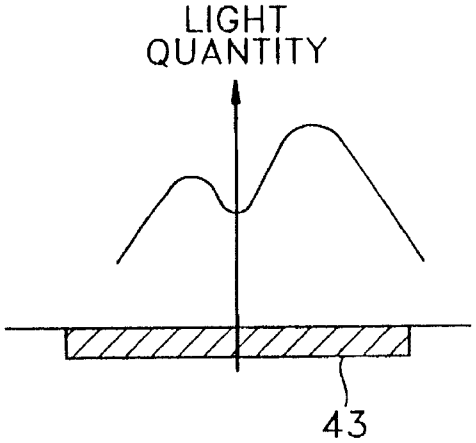
Figure 7:
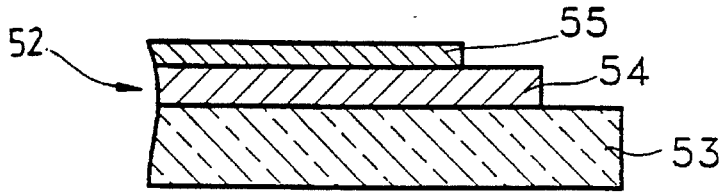
Figure 8:
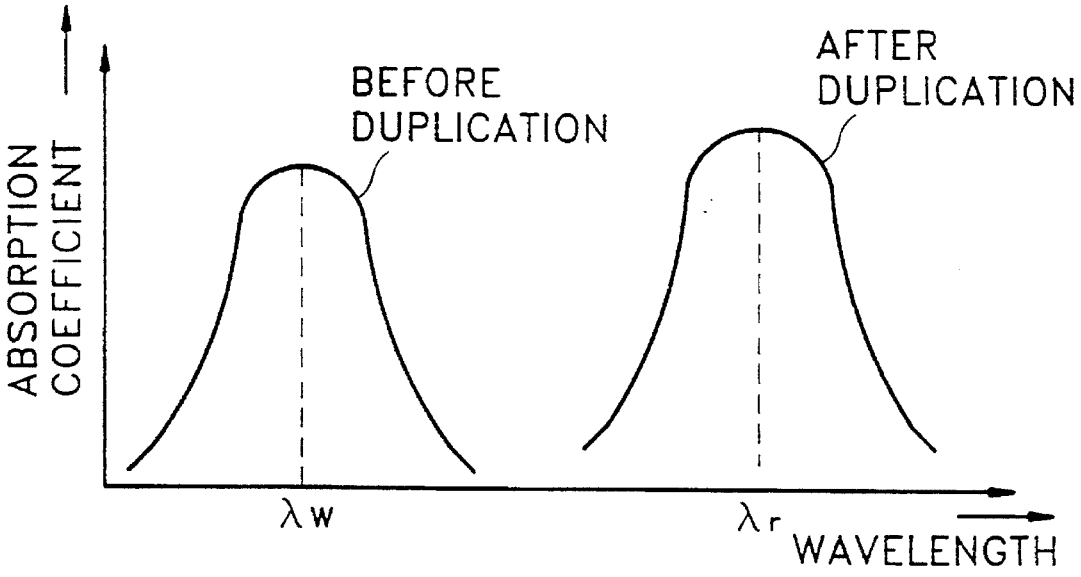
Figure 9:
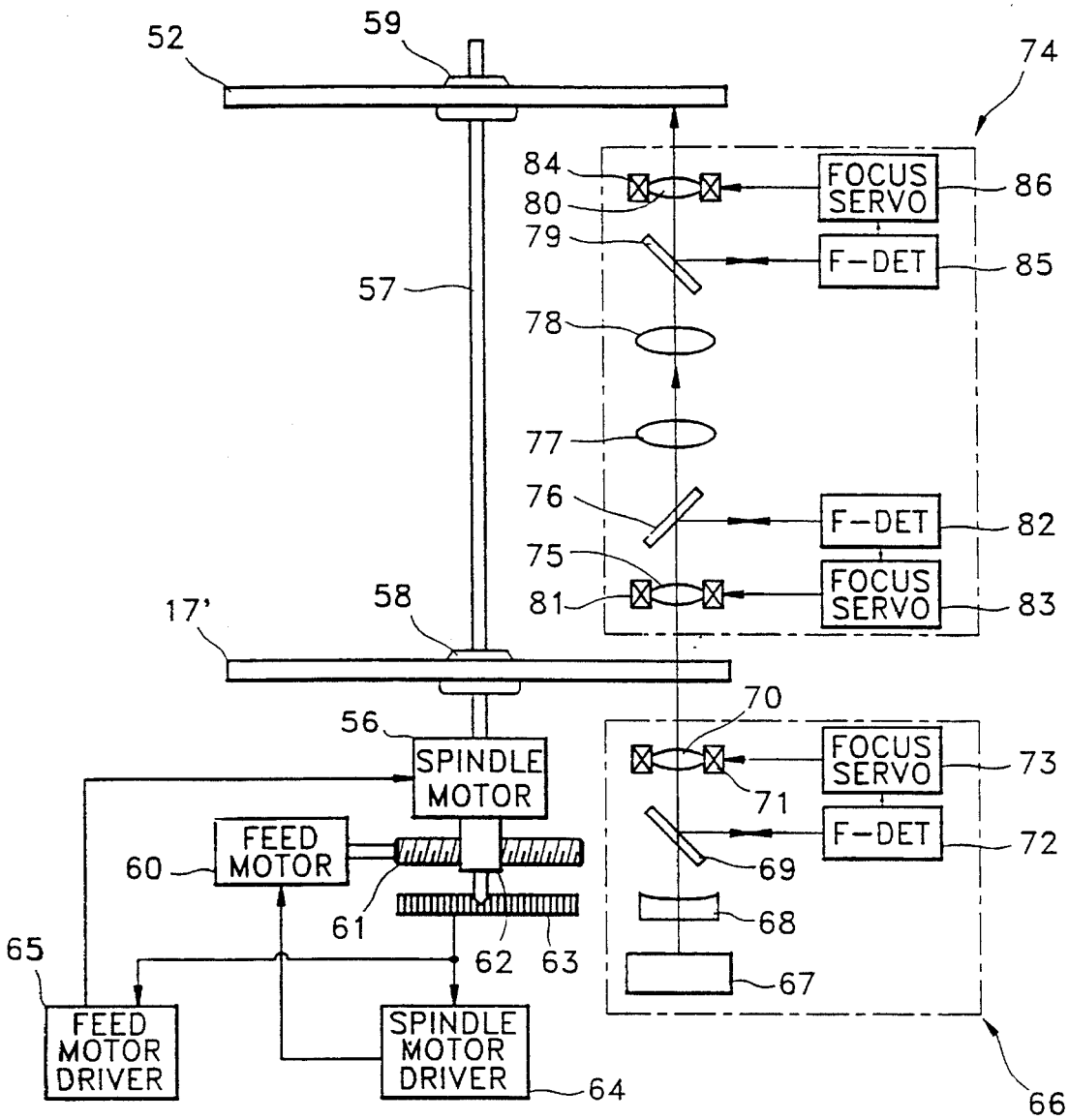
Figure 10:
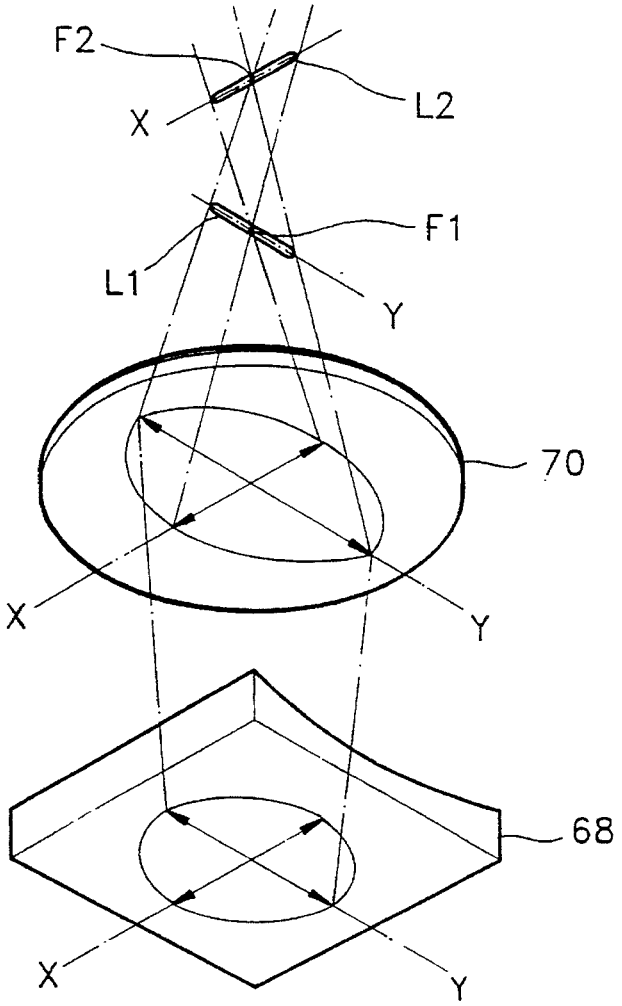
Figure 11:
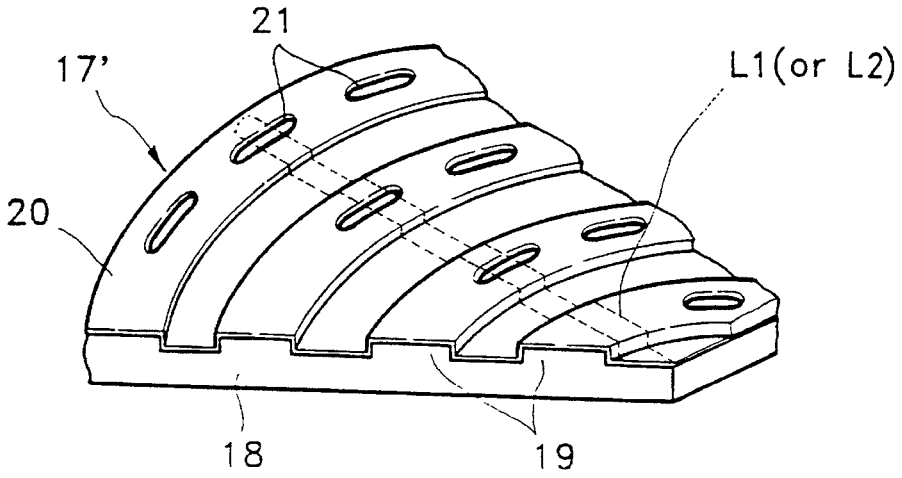
Figure 12:
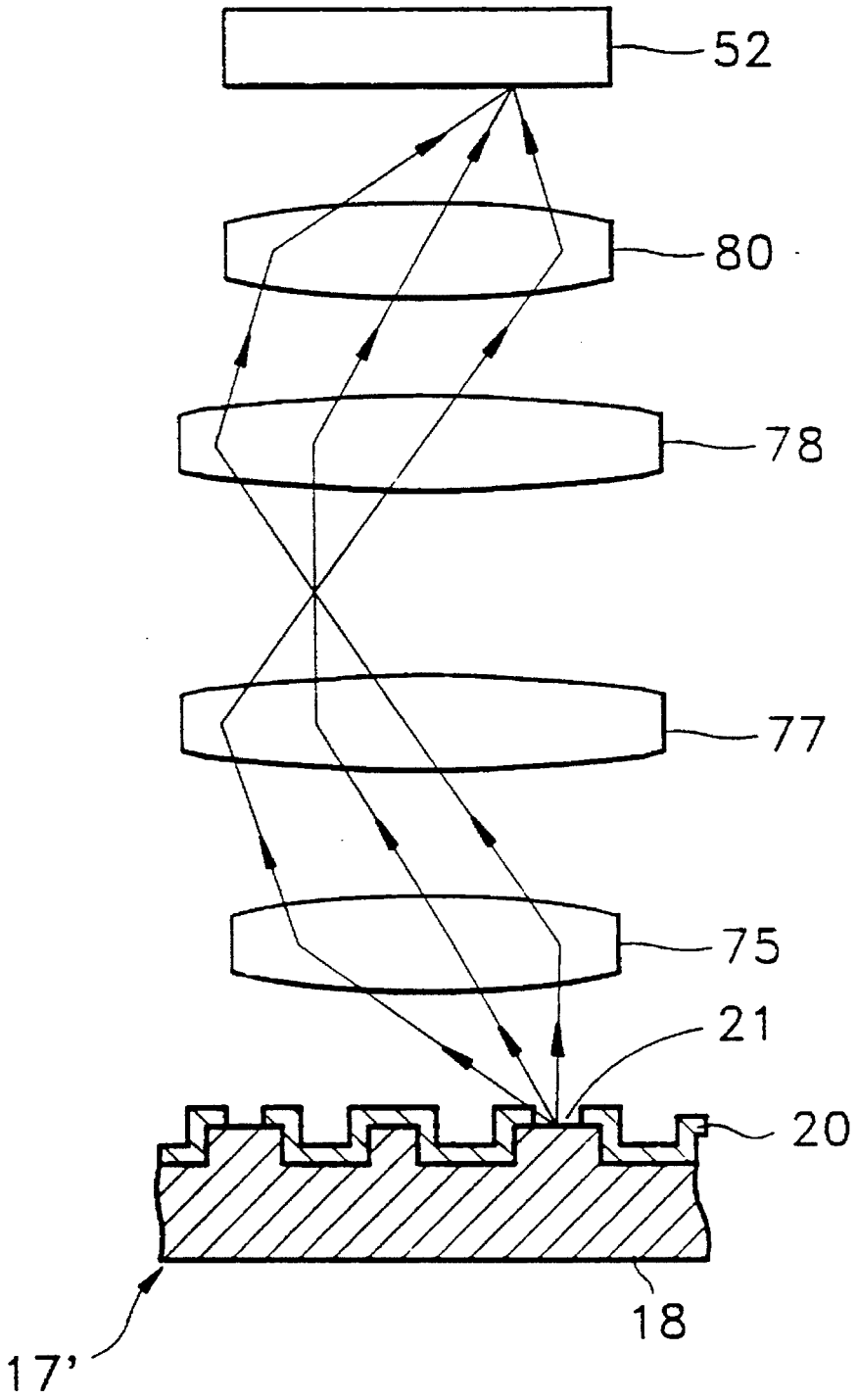

The present invention relates to new types of polymeric latices and their use in photographic materials.

2. Background of the Invention

Coated photographic layers and complete photographic materials must comply with a number of requirements concerning physical properties. In order to avoid physical damage during manufacturing and handling a photographic material must show a sufficiently high scratch resistance. Furtheron, photographic materials must show a good flexibility so that easy handling without the occurence of creases or cracks is possible; in other words, the materials may not suffer from brittleness especially under critical low humidity conditions. On the other hand, stickiness should be avoided. Still furtheron, photographic materials must show a good dimensional stability, meaning a minimal dimensional distortion during processing especially during the drying phase at elevated temperature. The requirement of dimensional stability is particularly stringent for graphic arts contact materials often serving in pre-press activity as final intermediates between colour separations produced on a scanner and the exposure step onto a printing plate. Several contacts, being duplicates of different separations, have to be exposed in register on one and the same printing plate and mutually different dimensional distortions would lead to unacceptable colour shifts on image edges in the final print.

As well known in the art flexibility and dimensional stability can be improved by the incorporation of so-called plasticizers. These substances can be relatively low-molecular weight compounds, preferably containing several hydrophilic groups like hydroxyl groups, or they can be polymer latices preferably having a rather low glass transition temperature. The former act in an indirect way by retaining enough water in the gelatinous layer even at low relative humidity. In this way the layer is kept sufficiently flexible at room temperature, even at a high hardening degree of the gelatinous layer while the required dimensional stability is assured.

Representative plasticizers include alcohols, dihydric alcohols, trihydric alcohols and polyhydric alcohols, acid amides, cellulose derivatives, lipophilic couplers, esters, phosphate esters such as tricresyl phosphate, glycol esters, diethylene glycol mixed esters, phthalate esters such as dibutyl phthalate and butyl stearate, tetraethylene glycol dimethyl ether, ethyl acetate copolymers, lactams, lower alkyl esters of ethylene bis-glycolic acid, esters or diesters of an alkylene glycol or a polyalkylene glycol, polyacrylic acid esters, polyethylene imines, poly(vinyl acetate) and polyurethanes, as illustrated by Eastman et al U.S. Pat. No. 306,470, Wiest U.S. Pat. No. 3,635,853, Milton et al U.S. Pat. No. 2,960,505, Faber et al U.S. Pat. No. 3,412,159, Ishihara et al U.S. Pat. No. 3,640,721, Illingsworth et al U.S. Pat. No. 3, 0003, 878, Lowe et al U.S. Pat. No. 2,327,808, Urnberger U.S. Pat. No. 3,361,565, Gray U.S. Pat. No. 2,865,792, Milton U.S. Pat. Nos. 2,904,434 and 2,860,980, Milton et al U.S. Pat. No. 3,033,680, Dersch et al U.S. Pat. No. 3,173,790, Fowler U.S. Pat. No. 2,772,166 and Fowler et al U.S. Pat. No. 2,835,582, Van Paesschen et al U.S. Pat. No. 3,397,988, Balle et al U.S. Pat. No. 3,791,857, Jones et al U.S. Pat. No. 2,759,821, Ream et al U.S. Pat. No. 3,287,289 and De Winter et al U.S. Pat. No. 4,245,036.

Low-molecular plasticizers with hydrophilic groups show the disadvantage of rendering the coated hydrophilic layer(s) of a photographic element sticky particularly at elevated relative humidity. When photographic materials are packaged, stored and delivered in a web-like or sheet-like manner an unacceptable adherance of support parts to surface parts can occur during storage or after processing. Moreover, they are not diffusion resistant. On the other hand, plasticizers consisting of conventional polymer latices, e.g. polyethylacrylates and analogues which are widely used in commercial materials, show other drawbacks. The amount of latex which can be incorporated in a gelatinous layer in order to improve dimensional stability is limited because high concentrations of the latex disturb the cohesion of the gelatine matrix resulting in a decrease of the scratch resistance eventually below a critical level.

So there is a need for new types of latices which can be incorporated in gelatinous layers upto higher latex/gelatin ratios without affecting the scratch resistance too strongly. Attempts to provide latices giving improved physical properties are disclosed e.g. EP 0 477 670, which describes the use of gelatin-grafted latices, in WO/14968, which discloses reduced pressure fog with uncase-hardened and case-hardened gelatine-grafted polymer latices, and in EP 0 219 101 which discloses incorporation of high quantities of hydrophobic latices by surrounding them during preparation with natural water-soluble polymers like dextranes. U.S. Pat. No. 4,714,671 discloses polymer latices in which the dispersed particles consist of a soft hydrophobic core and a hard shell giving rise to suitable plasticizers which do not diffuse out of the layer under tropical conditions.

The present invention extends the teachings on improved polymer latices for use as plasticizers in photographic materials.

It is an object of the present invention to provide new types of latices which can be incorporated in gelatinous layers in high concentrations while retaining good scratch resistance.

It is a further object of the present invention to provide improved photographic materials showing an excellent compromise between dimensional stability, flexibility and scratch resistance.

Other objects of the invention will become apparent from the description hereafter.

3. Summary of the Invention

The objects of the present invention are realized by providing a photographic material, comprising a support, at least one silver halide emulsion layer, and optionally one or more other hydrophilic layer(s), characterized in that at least one of said emulsion or other hydrophilic layer(s) contains a polymer latex with an average particle size of less than 500 μm, which is obtained by subjecting to radical emulsion polymerisation one or more radical-polymerisable monomers, whose emulsifier-free homopolymers or copolymers possess a glass transition temperature below 65° C., preferably below 30° C., in the presence of a water-soluble polymer of formula I (I)

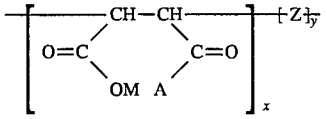

wherein

Z is $—CH_2—CR^1R^2—$(I.1) or (I.2)

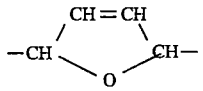

M represents H, Na, K, Li, or $NH_4$,

R represents H or $CH_3$, $R^2$ represents H, $C_1$–$C_6$ unsubstituted or sustituted alkyl (preferably $—CH_3$, $—C_2H_5$, $—C_4H_9$, $—CH_2C(CH_3)_3$), unsubstituted or substituted aryl (preferably phenyl or tolyl), $—(CH_2)m—OCO—R^5$, wherein $R^5$ corresponds to $C_1$–$C_8$ alkyl and m is 0 or 1,

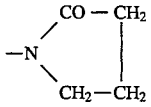

A represents OM, $OR^3$, $NH_2$, $NHR^3$, $O—R^4—(SO_3M)_n$ or $NH—R^4—(SO_3M)_n$, wherein $R^3$ represents $C_1$–$C_4$ alkyl, $R^4$ represents an aliphatic or aromatic residue of 1 to 10 C atoms, preferably a residue derived from a $C_1$–$C_4$ alkane or from benzene, methylbenzene or naphthalene, n is 1 or 2, and x,y are chosen in such a way that the weight-average molecular weight of polymer I is comprised between 5,000 to 500,000, preferably between 10,000 and 200,000, and the ratio x:y is comprised between 1:4 and 1:1 preferably between 1:3 and 1:1.

The described emulsion polymer latices are new themselves with the exception of those compounds (I.1) wherein A equals $NH—R^4—(SO_3M)_n$. The preparation of these latter latices and their use in paper sizing agents is known from DE 3807097.

It was found surprisingly that the incorporation of the invention latices in one or more hydrophilic layers of a photographic material drastically improved the scratch resistance/concentration relationship compared to conventional latices as polyethylacrylate and analogues. In this way it became possible to improve the dimensional stability of the photographic material sufficiently without decreasing the scratch resistance below an unacceptable level.

4. Detailed Description

The polymers 1.1 are known (DE 3344470, DE 3807097, DE 3429961, DE 3609981, DE 3703551, DE 3331542, EP 0 307 778, EP 0 009 185, DE4034871, U.S. Pat. No. 4,151,336, *J. Am. Chem. Soc.* Vol. 68 (1946) p. 1495, *J. Macromol. Sci.-Chem.* Vol. A6(8) (1972) p. 1459, *J. Macromol. Sci.-Chem.* Vol. A4(1) (1970) p. 51).

The polymers are formed in a reaction of alternatingly or statistically composed copolymers II of maleic acid anhydride and α-olefins (II)

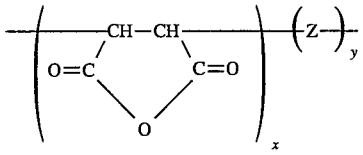

with the acid anhydride ring of II splitting reagents III.

Suitable α-olefins are those having 2 to 9 C atoms such as, e.g., ethylene, propylene, butene-1, isobutylene and α-methylstyrene. Especially preferred are α-diisobutylene, styrene and vinyl esters such as vinyl acetate or vinyl esters of branched-chain carboxylic acids (®Lican 261, -270, -279, -288 or -245 from Huels AG). The preparation of their copolymers with maleic anhydride is known in principle and described, e.g., in "Houben-Weyl, Methoden der organischen Chemie, Bd. E XIV, Teil 2, Georg Thieme Verlag, Stuttgart, 1987".

The acid anhydride ring-splitting reagents III are

III a) bases, preferably sodium hydroxide or potassium hydroxide,

III b) short-chained alcohols or alcoholates having up to 4 C atoms,

III c) ammonia or short-chained amines having up to 4 C atoms,

III d) aminosulphonic acids of following formula:

$$H_2N—R^4—(SO_3M)_n,$$

wherein $R^4$, M, and n have the significances given in formula I. Suitable examples include 2-aminoethanesulphonic acid, 2-, 3-, or 4-aminobenzenesulphonic acid, aminonaphthalenesulphonic acids, 4-amino-1,3-benzenedisulphonic acid, 5-amino-1,3-benzenedisulphonic acid and 2-amino-1,4-benzenedisulphonic acid or alkali salts of these sulphonic acids, or III e) propanesulton or butanesulton.

The polymers I.2 can be prepared in a similar way from known copolymers of maleic acid anhydride and furan (See *J. Am. Chem. Soc.* Vol. 68 (1946) p. 1495, *J. Macromol. Sci.-Chem.* Vol. A6(8) (1972) p. 1459, *J. Macromol. Sci.-Chem.* Vol. A4(1) (1970) p. 51, both cited above) by the ring splitting reagents III.

Suitable polymers I.1 are, e.g.:

(Ia-1)

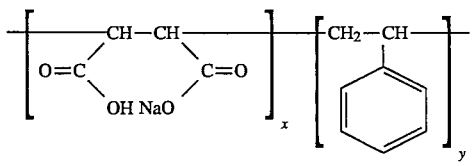

(Ia-2)

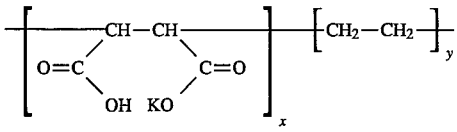

-continued
(Ia-3)
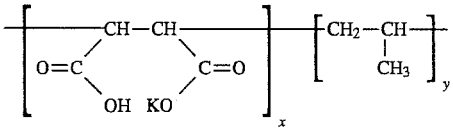
(Ia-4)
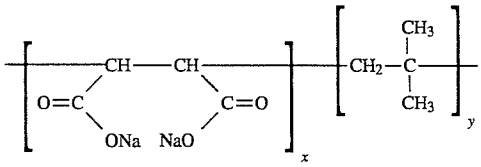
(Ia-5)
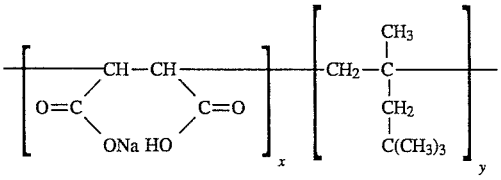
(Ia-6)
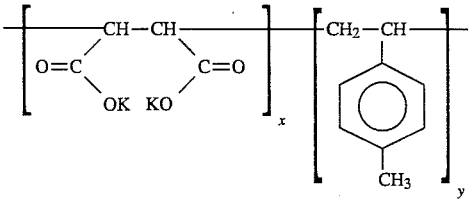
(Ia-7)
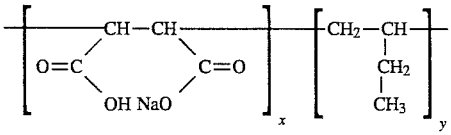
(Ib-1)
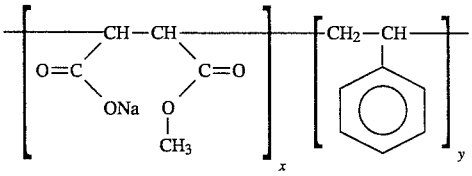
(Ib-2)
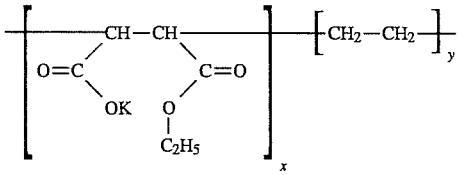
-continued
(Ib-3)
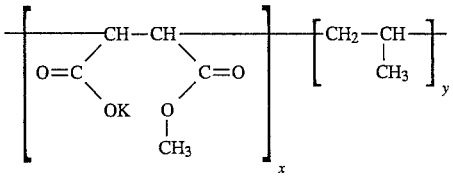
(Ib-4)
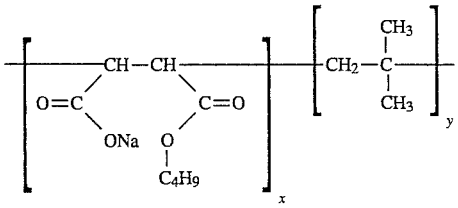
(Ib-5)
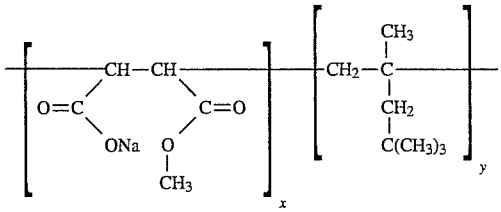
(Ib-6)
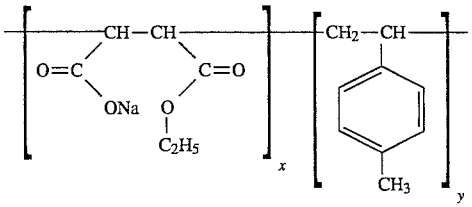
(Ib-7)
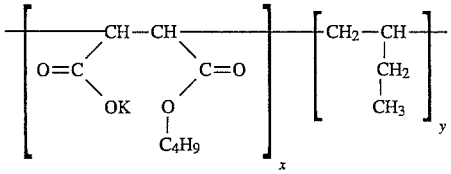
(Ic-1)
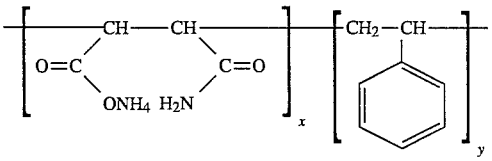
(Ic-2)
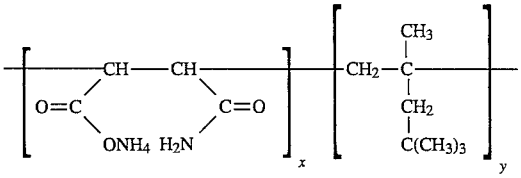

-continued
(Ic-3)
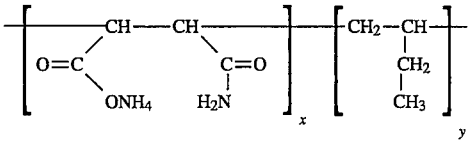
(Id-1)
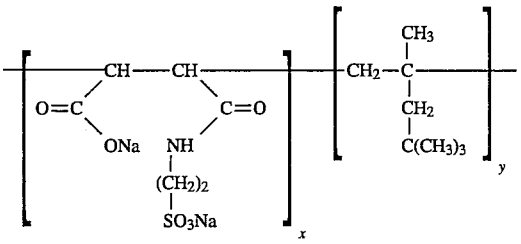
(Id-2)
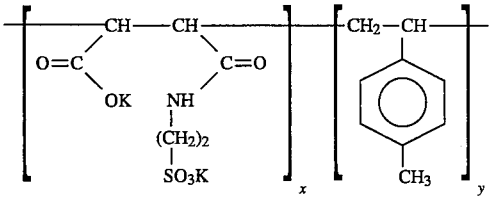
(Id-3)
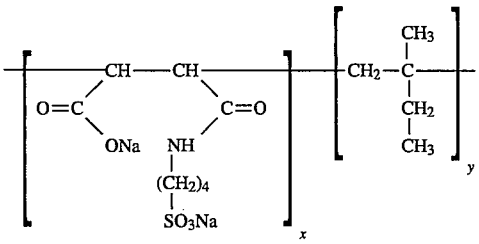
(Ie-1)
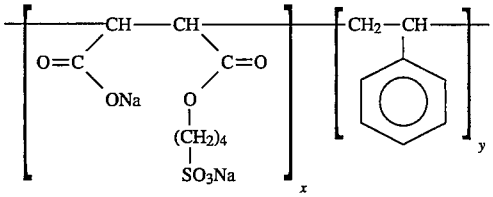
(Ie-2)
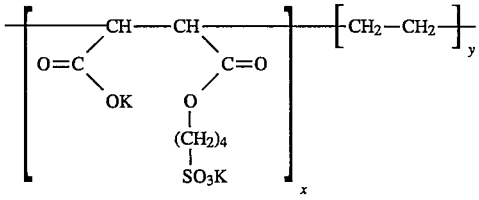
-continued
(Ie-3)
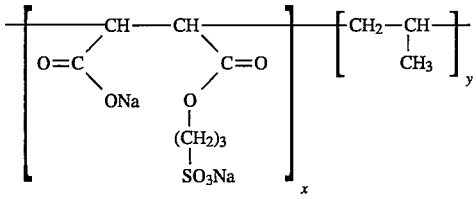
(Ie-4)
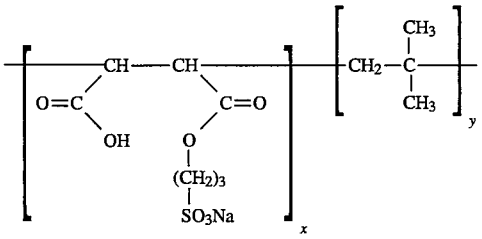
(If-1)
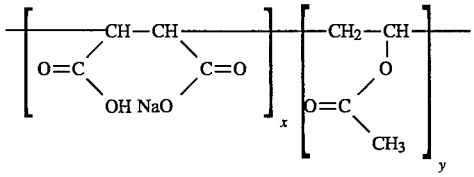
(If-2)
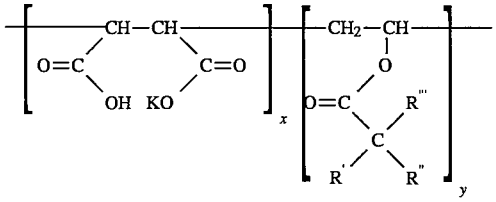
(mixture wherein the sum of R', R" and R'" represents $-C_7H_{17}$)
(If-3)
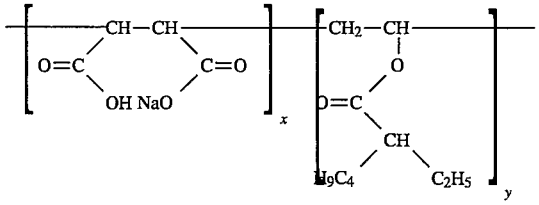
A suitable polymer I.2 is:
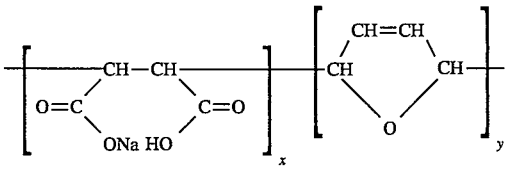

Preference is given to the polymers Ia-5 and Ic-1. Especially preferred are the polymers Ia-1 and Id-1.

The polymers I may also be mixtures wherein preferably more than 80% especially more than 90%, based on the mixture, are structural units I. Possible structural units that can be contained in the mixtures of I result, e.g., from the incomplete conversion of the maleic anhydride groups,

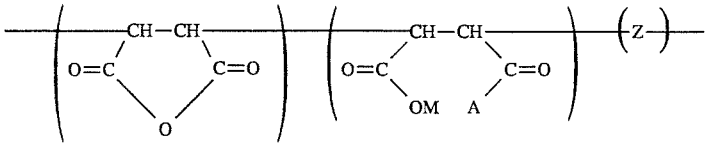

conversion of an acid anhydride group by water,

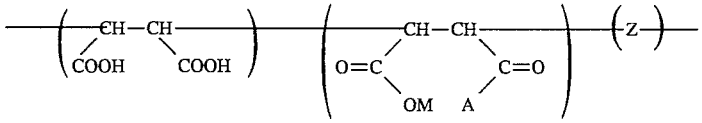

double conversion of an acid anhydride group in case of an excess of alcohol reagent,

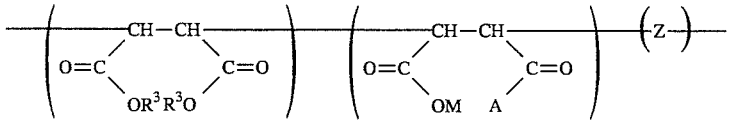

double conversion of an acid anhydride group with an amine or an aminoalkylsulphonic acid, under specific reaction conditions, with formation of an imide.

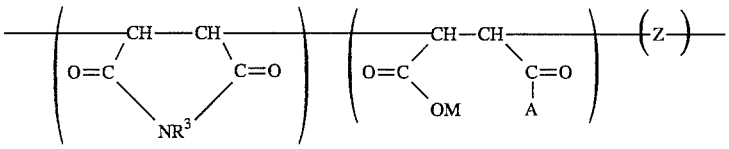

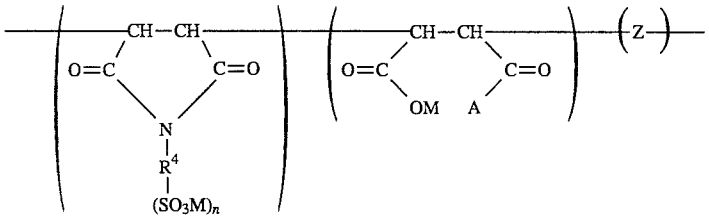

or by adding a third monomer, so that modified polymers form which contain terpolymeric units; examples:

(Ig-1)

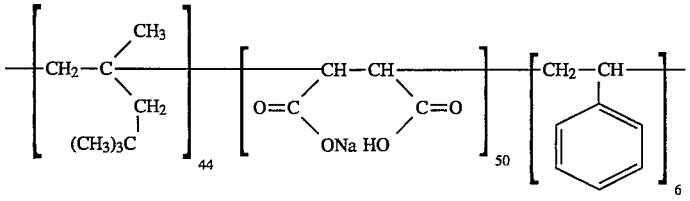

(Ig-2)

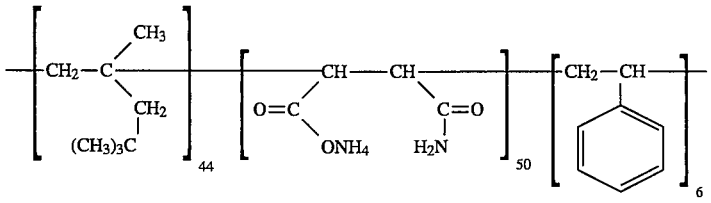

(Ig-3)

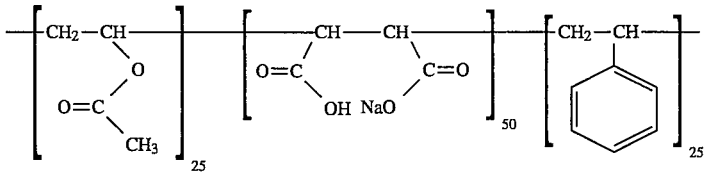

(Ig-4)

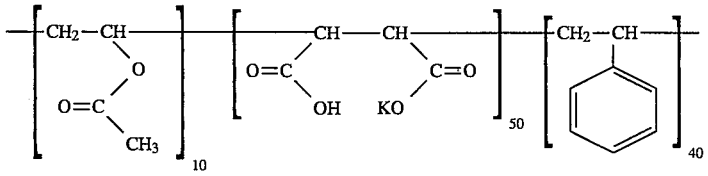

The polymers (I) are used in the emulsion polymerisation according to the invention in an amount of 0.5 to 35, preferably of 2 to 10% by weight, based on the amount of monomers to be polymerised. They possess a.o. emulsifying properties and are being grafted at least partially by the radical-polymerising monomers.

The monomers according to the invention to be radical-polymerised in the presence of the polymers I are e.g. (meth) acrylic acid esters, mixtures of (meth) acrylic acid esters or monomer mixtures that contain at least 50% by weight of (meth) acrylic acid esters, provided that the glass temperature of the emulsifier-free polymers of the used monomers or monomer mixtures are below 65° C.

By the term (meth) acrylic acid esters within the scope of this invention are to be understood esters of methacrylic- and acrylic acid. Suitable (meth)acrylic acid esters are, e.g.:

2-Propenoic acid, methylester
2-Propenoic acid, pentyl ester
2-Propenoic acid, butyl ester
2-Propenoic acid, phenylmethyl ester
2-Propenoic acid, cyclohexyl ester
2-Propenoic acid, cyclopentyl ester
2-Propenoic acid, hexadecyl ester
2-Propenoic acid, 2-methylpropyl ester
2-Propenoic acid, 2-ethylhexyl ester
2-Propenoic acid, 2-(1-ethyl)pentyl ester
2-Propenoic acid, 2-(2-ethoxyethoxy)-ethyl ester
2-Propenoic acid, 2-butoxyethyl ester
2-Propenoic acid, 2-(2-methoxyethoxy)-ethyl ester
2-Propenoic acid, 2-n-propyl-3-i-propylpropyl ester
2-Propenoic acid, octyl ester
2-Propenoic acid, octadecyl ester
2-Propenoic acid, 2-ethoxyethyl ester
2-Propenoic acid, 2-methoxyethyl ester
2-Propenoic acid, 2-(methoxyethoxy)ethyl ester
2-Propenoic acid, ethyl ester
2-Propenoic acid, propyl ester
2-Propenoic acid, 2-phenoxyethyl ester
2-Propenoic acid, phenyl ester
2-Propenoic acid, 1-methylethyl ester
2-Propenoic acid, hexyl ester
2-Propenoic acid, 1-methylpropyl ester
2-Propenoic acid, 2,2-dimethylbutyl ester Especially suited (meth)acrylic acid esters are 2-propenoic acid methyl ester, 2-propenoic acid n-butyl ester and 2-propenoic acid ethyl ester.

In a further preferred embodiment, in addition to the described (meth)acrylic acid esters, up to 50%, preferably 1 to 20%, of vinyl monomers are used that contain anionic groups or form such groups depending on the pH.

Preference is given to vinyl monomers that contain carboxylate groups or sulphonate groups or that are capable of forming them by a variation of the pH. Examples of preferred vinyl monomers of this kind are 1-Propene-1,2,3-tricarboxylic acid
2-Propenoic acid 2-Propenoic acid, sodium salt
2-Chloro-2-propenoic acid
2-Propenoic acid, 2-carboxyethyl ester
2-Methyl-2-propenoic acid
2-Methyl-2-propenoic acid, lithium salt
Methylenebutanedioic acid
2-Butenedioic acid
2-Methylbutenedioic acid
2-Methylenepentendioic acid
2-Carboethoxyallyl sulfate, sodium salt
2-Propenoic acid, ester with 4-hydroxy-1-butanesulphonic acid, sodium salt
2-Propenoic acid, ester with 4-hydroxy-2-butanesulphonic acid, sodium salt
3-Allyloxy-2-hydroxypropanesulphonic acid, sodium salt
2-Methyl-2-propenoic acid, ester with 3-[tert-butyl(2-hydroxyethyl)amino]propane sulphonic acid
Ethenesulphonic acid, sodium salt
Methylenesuccinic acid, diester with 3-hydroxy-1-propane sulphonic acid, disodium salt
2-Methyl-2-propenoic acid, ester with 2-(sulphooxy) ethyl, sodium salt
N-3-Sulphopropyl acrylamide, potassium salt
2-Methyl-2-propenoic acid, 2-sulphoethyl ester
2-Methyl-2-propenoic acid, 2-sulphoethyl ester, lithium salt
p-Styrene sulphonic acid, ammonium salt
N-1,1-dimethyl-2-sulphoethyl acrylamide, sodium salt
p-Styrene sulphonic acid, potassium salt
p-Styrene sulphonic acid
4-4-Ethenylbenzenesulphonic acid, sodium salt,
2-Propenoic acid, 3-sulphopropyl ester, sodium salt
m-Sulphomethylstyrene sulphonic acid, potassium salt
p-Sulphomethylstyrene sulphonic acid, sodium salt
2-Methyl-2-propenoic acid, 3-sulphopropyl ester, sodium salt
2-Methyl-2-propenoic acid, 3-sulphobutyl ester, sodium salt
2-Methyl-2-propenoix acid, 4-sulphobutyl ester, sodium salt
2-Methyl-2-propenoic acid, 2-sulphoethyl ester, sodium salt
2-Methyl-2-[(1-oxo-2-propenyl)amino]-1-propane sulphonic acid
2-Methyl-2-[(1-oxo-2-propenyl)amino]-1-propane sulphonic acid, sodium salt
2-Methyl-2-[(1-oxo-2-propenyl)amino]-1-propane sulphonic acid, potassium salt Especially preferred vinyl monomers with anionic groups are 2-propenoic acid sodium salt and N-1,1-dimethyl-2-sulphoethyl acrylamide sodium salt.

Moreover, mixtures according to the invention of radical-polymerisable monomers can contain such vinyl monomers up to 25% by weight, preferably 0.5 to 15% by weight, which are capable of reacting with gelatine or with gelatine hardeners that are of common use in photographic layers.

Suitable vinyl monomers that are reactive with respect to gelatine or gelatine hardeners are
2-Chloroethylacrylate
Acetoacetoxyethylacrylate
3-Chloromethylstyrene
4-Chloromethylstyrene
2-Cyano-N-2-propenylacetamide
2-Methyl-2-propenoic acid, 2-aminoethyl ester, hydrochloride
2-Propenoic acid, 2-aminoethyl ester
N-Methacryloyl-N'-glycylhydrazine hydrochloride
5-Hexene-2,4-dione
5-Methyl-5-hexene-2,4-dione
2-Methyl-2-propenoic acid, 2-[(cyanoacetyl)-oxy]ethyl ester
2-Propenoic acid, oxidranylmethyl ester
2-Methyl-2-propenoic acid, oxidranylmethyl ester
Acetoacetoxy-2,2-dimethylpropyl methacrylate
3-Oxo-4-pentenoic acid, ethyl ester
N-(2-Aminoethy)-2-methyl-2-propenamide, monohydrochloride
3-oxo-butanoic acid, 2-[(2-methyl-1-oxo-2-propenyl)oxy] ethyl ester
2-Propenamido-4-(2-chloroethylsulphonylmethyl)benzene
3-(2-ethyl sulphonylmethyl)styrene
4-(2-ethylsulphonylmethyl)styrene
N-(2-Amino-2-methylpropyl)-N'-ethenylbutanediamide
Propenamide
Acetoacetoxyethylmethacrylate Preferred vinyl monomers that are reactive with respect to gelatine or gelatine hardeners are acetoacetoxyethylmethacrylate and 4-chloromethylstyrene.

The radical-polymerisable monomer mixtures according to the invention may contain further vinyl monomers that contribute to a further modification of the emulsion polymer, e.g. with respect to its glass transition temperature, its refractive indices or gel content, as long as the emulsifier-free polymers derived from those monomer mixtures possess a glass transition temperature below 65° C., preferably below 30° C.

Preferred vinyl monomers of this kind are
Allylmethacrylate
Tetraallyloxyethane
Acrylamide
Styrene
(1-Methylethenyl)benzene
3-Octadecyloxystyrene
4-Octadecyloxystyrene
N-(3-Hydroxyphenyl)-2-methyl-2-propenamide
2-Propenoic acid, 2-hydroxyethyl ester
2-Propenoic acid, 2-hydroxypropyl ester
N-(1-Methylethyl)-2-propenamide
3-Ethenylbenzoic acid
4-Ethenylbenzoic acid
N-(2-Hydroxypropyl)-2-methyl-2-propenamide
N,2-Dimethyl-2-propenamide
2-Methyl-2-propenamide
N-(2-Hydroxypropyl)-2-methyl-2-propenamide
N-[2-hydroxy-1,1-bis(hydroxymethyl)ethyl]-2-propenamide
N-(1,1-Dimethylethyl)-2-propenamide
Acetic acid ethenyl ester
3-Methylstyrene
4-Methylstyrene
N,N-dimethyl-2-propenamide
Ethyleneglycoldimethacrylate
Furan In a particularly preferred embodiment the radical-polymerisable monomers comprise a mixture of n.-butylacrylate (preferably higher then or equal to 41%), methylmethacrylate (preferably lower then or equal to 56%) and acrylic acid (preferably between 1 and 3%).

As initiators are taken into account in general 0.05 to 5% by weight, based on the monomers, of initiators decomposing in radicals. Such initiators are, e.g., organic peroxides, such as lauroyl peroxide, cyclohexanone hydroperoxide, tert.-butyl peroctoate, tert.-butyl perpivalate, tert.-butyl perbenzoate, dichlorobenzoyl peroxide, benzoyl peroxide, di-tert.-butyl peroxide, tert.-butyl hydroperoxide, cumol hydroperoxide, peroxycarbonates such as diisopropyl peroxidicarbonate, dicyclohexyl peroxidicarbonate, diisooctyl peroxidicarbonate, sulphonyl peroxides such as acetylcyclohexylsulphonyl peracetate, sulphonylhydrazides, azo compounds such as azodiisobutyric acid nitrile as well as better water-soluble azo compounds as described, e.g., in DE-A-2841045. Inorganic peroxides such as hydrogen peroxide, potassium peroxodisulphate and ammonium peroxodisulphate are suited as well. The initiators decomposing in radicals can be used alone or in combination with reducing agents or heavy metal compounds. Such compounds are, e.g., sodium- or potassium pyrosulphite, formic acid, ascorbic acid, thiourea, hydrazine- or amine derivatives and RONGALIT (1-hydroxymethanesulphinic acid Na-salt). The heavy metal compounds can be present in oil-soluble as well as in water-soluble form. Examples of water-soluble heavy metal compounds are silver nitrate, halides and sulphates of 2- and 3-valent iron, cobalt, nickel and salts of titanium or vanadium in low valency stages. Examples of oil-soluble heavy metal compounds are cobalt naphthenate and the acetylacetone complexes of vanadium, cobalt, titanium, nickel and iron.

The emulsion polymerisations take place at temperatures between 20° and 100° C., preferably between 40° and 85° C.

The amount of other emulsifying agents that can be used in addition to the polymers I is 0° to 20%, preferably 1 to 5%, based on the monomers to be polymerised. Artionic as well as non-ionic emulsifying agents are suited therefore. As examples can be mentioned alkyl- and aryl sulphonates such as dodecylsulphonic acid Na-salt, the N-methyl taurinate product with oleic acid (HOSTAPON T) and sulphonated dodecylphenyl phenyl ethers (Dow FAX 2A1), alkyl- and aryl sulphates such as the sodium sulphate of oxethylated nonylphenol (HOSTAPAL B), poly(vinyl alcohol), oxethylated phenols, oleyl alcohol polyglycol ethers, oxethylated polypropylene glycol or natural products such as gelatine and fish glue.

Carrying out the emulsion polymerisation can take place in such a way that an aqueous solution of polymer I, optionally together with other emulsifying agents, is prepared and then the monomers and the initiator are fed separately. It is also possible, however, to prepare only a part of polymer I in water, optionally together with other emulsifying agents and to feed the remainder together with the monomers, the initiator and optionally additional emulsifying agents in separate fluxes. Alternatively, one can proceed in such a way that an aqueous solution of polymer I, monomers, initiator and optionally other emulsifying agents are fed continuously or intermittently over the entire period of polymerisation and that only a determined amount of water is used. Further, the polymerisations according to the invention are likewise suited for carrying out a batch-wise process, according to which polymer I, monomer (mixture), initiator and optionally further emulsifying agents are applied together and brought to the desired polymerisation temperature.

In a special embodiment of the emulsion polymerisation only a part of the monomers is first polymerised according to a batch-wise process, whereupon further monomers are fed, occasionally together with initiator and emulsifying agent. The applied and dropwise added monomer (mixture) can then be composed differently.

If polymer I is being applied as an aqueous solution, it may be advantageous for the polymerisation to heat the receiver together with the initiator to 40° to 85° C. for some time, e.g. between 10 and 180 min, before adding the monomers.

One can proceed e.g. as follows in the emulsion polymerisation according to the invention:

Under nitrogen atmosphere an aqueous solution of polymer I together with potassium peroxidisulphate is prepared. The preparation is heated at 65° C. with stirring for some time, whereupon first an aqueous solution of a low-molecular emulsifying agent is added at once and then the monomer mixture within some period of time.

After the temperature rise of the starting exothermic reaction is finished, the mixture is stirred at increased temperature, demonomerised at 90° C. under reduced pressure, cooled and mixed with a 20% solution of 1000 ppm of phenol in ethanol/water (1:1).

After completion of the emulsion polymerisation in the illustrated way, a fine, aqueous polymer emulsion with average particle size between 30 and 500 nm has formed.

The type of photographic material in which the polymer latices are incorporated according to the present invention and its field of use is not limited in any way. It includes photographic elements for graphic arts and for so-called amateur and professional black-and-white or colour photography, cinematographic recording and printing materials, X-ray diagnosis, diffusion transfer reversal photographic elements, low-speed and high-speed photographic elements, etc. However the advantages of the present invention become most perspicuous when the latices are incorporated in photographic materials setting high standards to dimensional stability, e.g. graphic arts contact materials as explained in the background section. Several types of commercial contact materials are available. Duplicating materials can be of the classical dark room type but in recent times preference is given to so-called daylight or roomlight contact materials which can be handled for a reasonable period under UV-poor ambient light. Also yellow light contact materials exist which can be handled under relative bright yellow light. Very insensitive daylight types are available which have to be exposed by strongly emitting metal-halogen sources. Less insensitive types are designed for exposure by quartz light sources. The daylight materials can be of the negative working type or of the direct positive working type.

Usually in black-and-white materials the silver halide emulsion layer simply consists of just one layer. However double layers and even multiple layer packs are possible. Apart from the emulsion layer a photographic element usually comprises several non-light sensitive layers, e.g. protective layers, backing layers, filter layers and intermediate layers (or "undercoats"). All of these layers can be single, double or multiple. The polymer latices of the present invention can be present in all these layers, or in several of them, or in just one of them. In principle a mixture of two or more different latices can be used, or an invention latex can be mixed with a conventional plasticizer, but for normal practice just one representative of the new types will be sufficient.

In the preferred embodiment of a graphic arts contact material the plasticizer is preferably present in the emulsion layer in a plasticizer/gelatin ratio ranging from 0.2 to 1. When present in the protective layer the preferred ratio range is between 0.2 and 1 equally.

Apart from the polymer latex of the present invention the emulsion layer and the other hydrophilic layers can contain, according to their particular design and application, the typical and well-known photographic ingredients such as stabilizers, sensitizers, desensitizers, development accelerators, matting agents, spacing agents, anti-halation dyes, filter dyes, opacifying agents, antistatics, UV-absorbers, surfactants, gelatin hardeners such as formaldehyde and divinylsulphon.

The composition of the silver halide emulsion incorporated in a photographic element of the present invention is not specifically limited and may be any composition selected from e.g. silver chloride, silver bromide, silver iodide, silver chlorobromide, silver bromoiodide, and silver chlorobromoiodide. However in the preferred embodiment of a contact material, especially a daylight material, emulsions rich in chloride are preferred.

The photographic emulsion(s) can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966).

Two or more types of silver halide emulsions that have been prepared differently can be mixed for forming a photographic emulsion. The average size of the silver halide grains may range from 0.05 to 1.0 μm, preferably from 0.2 to 0.5 μm. For daylight materials the average grain size is preferably comprised between 0.07 μm and 0.20 μm. The size distribution of the silver halide particles can be homodisperse or heterodisperse.

The light-sensitive silver halide emulsions can be chemically sensitized as described e.g. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). However in the case of a contact daylight material the emulsion is preferably not chemically ripened and preferably contains relative high amounts of a desensitizer.

The light-sensitive silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. However in the particular case of a contact daylight material the emulsion is preferably not spectrally sensitized in view of the daylight stability.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion.

The photographic material of the present invention may further comprise various kinds of surface-active agents in the photographic emulsion layer or in another hydrophilic colloid layer. Suitable surface-active agents include nonionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration. Preferred surface-active coating agents are compounds containing perfluorinated alkyl groups.

In case of a photographic colour material the typical ingredients like colour forming agents, mask forming agents, Development Inhibitor Releasing couplers, and other Photographic Useful Group releasing couplers can be present.

The support of the photographic material can be a transparent base, preferably an organic resin support, e.g. cellulose nitrate film, cellulose acetate film, polyvinylacetal film, polystyrene film, polyethylene terephthalate film, polycarbonate film, polyvinylchloride film or poly-alpha-olefin films such as polyethylene or polypropylene film. The thickness of such organic resin film is preferably comprised between 0.07 and 0.35 mm. These organic resin supports are preferably coated with a subbing layer. On the other hand the support of the photographic material can be a paper base preferably a polyethylene or polypropylene coated paper base.

The photographic material can be exposed according to its particular composition and application, and processed by any means or any chemicals known in the art depending on its particular application.

The following preparative and photographic examples illustrate the present invention without however being limited thereto.

EXAMPLES

Examples of Synthesis

The used polymers I are copolymers that are composed alternatingly to a wide extent, if not stated otherwise.

Emulsion polymer 1

An aqueous solution of 40 g of polymer Ia-1 and 16 g of potassium peroxidisulphate in 800 ml of water was prepared under nitrogen atmosphere. The preparation was heated at 65° C. with stirring for 2 h, whereupon 240 ml of 1N sodium hydroxide solution, 640 g of 10% aqueous solution of HOSTAPON T and 4707 g of water were added at once. Then a monomer mixture consisting of 714.4 g of n-butyl acrylate, 869.6 g of methyl methacrylate and 16 g of acrylic acid was added within 1 min.

The mixture was stirred at 65° C. for another 16 h, cooled, mixed with a 20% solution of 1000 ppm of phenol in ethanol/water (1:1) and filtered through a 100-μm filter.

The obtained latex had a solids content of 21.9% (w/w), a pH of 6.6 and according to laser correlation spectroscopy an average particle size of 75 nm.

Emulsion polymer 2

An aqueous solution of 80 g of polymer Ia-1 and 16 g of potassium peroxidisulphate in 1600 ml of water was prepared under nitrogen atmosphere. The preparation was heated at 65° C. with stirring for 2 h, whereupon 340 ml of 1N sodium hydroxide solution, 640 g of 10% aqueous solution of HOSTAPON T and 3820 g of water were added at once. Then a monomer mixture consisting of 714.4 g of n-butyl acrylate, 869.6 g of methyl methacrylate and 16 g of acrylic acid was added within 1 min.

The mixture was stirred at 65° C. for another 16 h, cooled, mixed with a 20% solution of 1000 ppm of phenol in ethanol/water (1:1) and filtered through a 100-μm filter.

The obtained latex had a solids content of 21.6% (w/w), a pH of 6.4 and according to laser correlation spectroscopy an average particle size of 133 nm.

Emulsion polymer 3

500 g of an aqueous solution of 25 g of polymer Ia-1 together with 10 g of potassium peroxidisulphate was prepared under nitrogen atmosphere. The preparation was heated at 65° C. with stirring for 2 h, whereupon 150 ml of 1N sodium hydroxide solution, 400 g of 10% aqueous solution of HOSTAPON T and 2940 g of water were added at once. Then a monomer mixture consisting of 446.5 g of butyl acrylate, 543.5 g of methyl methacrylate and 10 g of acrylic acid was added within 15 min. After the temperature rise of the starting exothermic reaction had been completed, the mixture was stirred at 80° C. for another 2 h, demonomerised at 90° C., then cooled and mixed with a 20% solution of 1000 ppm of phenol in ethanol/water.

The obtained latex had a solids content of 22.0% (w/w), a pH of 5.7 and according to laser correlation spectroscopy an average particle size of 61 nm.

Emulsion polymer 4

With the restriction that instead of n-butyl acrylate an identic amount of ethyl acrylate was used, the polymerisation occurred as described under "emulsion polymer 3".

The obtained latex had a solids content of 22.7% (w/w), a pH of 5.7 and according to laser correlation spectroscopy an average particle size of 82 nm.

Emulsion polymer 5

25 g of a terpolymer consisting of 50 mol-% of maleic anhydride, 44 mol-% of α-diisobutylene and 6 mol-% of styrene were dissolved in a mixture of 3161 g of water and 431 ml of 1N sodium hydroxide solution (polymer Ig-1) and mixed with 10 g of potassium peroxidisulphate under nitrogen atmosphere. The mixture was heated at 65° C. with stirring for 2 h and then 400 ml of a 10% aqueous solution of HOSTAPON T were added quickly. Thereupon the monomer mixture consisting of 446.5 g of butyl acrylate, 543.5 g of methyl methacrylate and 10 g of acrylic acid was added within 15 min.

After the temperature rise of the starting exothermic reaction had been completed, the mixture was stirred at 80° C. for another 2 h, demonomerised at 90° C., then cooled and mixed with a 20% solution of 1000 ppm of phenol in ethanol/water.

The obtained latex had a solids content of 21.6% (w/w), a pH of 6.7 and according to laser correlation spectroscopy an average particle size of 79 nm.

Emulsion polymer 6

Unter nitrogen atmosphere a mixture was prepared of 640 g of water, 540 mg of RONGALIT C and 220 g of a 18.2% aqueous solution of a terpolymer that in a first stage was prepared from 50 mol-% of maleic anhydride, 44 mol-% of α-diisobutylene and 6 mol-% of styrene and thereupon was reacted with an amount of sodium taurinate aequimolar to that of maleic anhydride. The mixture was heated at 50° C. and then 25% of both solutions I and II were added at once. It was stirred at this temperature for 1 h whereupon the remainder of both solutions I and II was added simultaneously within 3 h.

solution I: 1.60 g of ammonium peroxidisulphate 140 g of water solution II: 200 g of ethyl acrylate After the addition was finished the mixture was stirred at 50° C. for another 6 h. The latex formed was degassed under reduced pressure at 60° C. and filtered through a 100-μm cloth. It had a solids content of 23.5% and according to laser correlation spectroscopy an average particle size of 52 nm.

Emulsion polymer 7

100 g of a terpolymer which in a first stage was prepared from 50 mol-% of maleic anhydride, 44 mol-% of α-diisobutylene and 6 mol-% of styrene and thereupon was reacted with an amount of sodium taurinate equimolar to that of the maleic anhydride, were dissolved in 2275 g of water and mixed with 10 g of potassium peroxidisulphate under nitrogen atmosphere. The preparation was heated at 65° C. with stirring for 1 h and then at the same time a monomer mixture consisting of 111.65 g of ethyl acrylate, 135.9 g of methyl methacrylate and 2.5 g of acrylic acid as well as 36.25 g of a 3.45% aqueous solution of potassium peroxidisulphate was added in 5 min. Stirring at 80° C. was continued for another 30 min whereupon once again a monomer mixture consisting of 334.5 g of ethyl acrylate, 407.6 g of methyl methacrylate and 7.5 g of acrylic acid as well as 108.75 g of a 3.45% aqueous solution of potassium peroxidisulphate were added at the same time in 90 min.

The mixture was stirred at 80° C. for another h, demonomerised at 90° C., then cooled and mixed with a 20% solution of 1000 ppm of phenol in ethanol/water.

The pH of the obtained latex was increased from 4.5 to 5.5 by adding 25 ml of 1N sodium hydroxide solution. The latex had a solids content of 26.7% (w/w) and according to laser correlation spectroscopy an average particle size of 78 nm.

Emulsion polymer 8

Unter nitrogen atmosphere 100 g of polymer Ie-1 were dissolved in 2275 ml of water and mixed with 10 g of potassium peroxidisulphate.

The further reactions occurred as described under "Emulsion polymer 3".

The pH of the obtained latex was 4.8 and was increased to 5.5 by adding 20 ml of 1N sodium hydroxide solution. The latex had a solids content of 26.4% (w/w) and according to laser correlation spectroscopy an average particle size of 286 nm.

Emulsion polymer 9

3340 g of an aqueous solution containing 25 g of polymer Ia-1 and 10 g of potassium peroxidisulphate was prepared under nitrogen atmosphere. This solution was heated at 65° C. with stirring for 2 h and thereupon at once 150 ml of 1N sodium hydroxide solution and 400 ml of a 10% aqueous solution of HOSTAPON T were added. Thereupon the monomer mixture consisting of 990 g of ethyl acrylate and 10 g of acrylic acid was added within 15 min. After the temperature rise of the starting exothermic reaction had been completed, the mixture was stirred at 80° C. for another 2 h, demonomerised at 90° C. then cooled and mixed with a 20% solution of 1000 ppm of phenol in ethanol/water.

The obtained latex had a solids content of 22.7% (w/w), a pH of 5.6 and according to laser correlation spectroscopy an average particle size of 129 nm.

Emulsion polymer 10

With the restriction that a modified monomer mixture consisting of 840 g of ethyl acrylate, 100 g of methyl methacrylate, 10 g of acrylic acid and 50 g of acetoacetoxyethyl methacrylate was used, the polymerisation occurred as described under "Emulsion polymer 9".

The obtained latex had a solids content of 22.2% (w/w), a pH of 5.9 and according to laser correlation spectroscopy an average particle size of 108 nm.

Emulsion polymer 11

With the restriction that a modified monomer mixture consisting of 790 g of ethyl acrylate, 100 g of methyl methacrylate, 10 g of acrylic acid and 100 g of acetoacetoxyethyl methacrylate was used, the polymerisation occurred as described under "Emulsion polymer 9".

The obtained latex had a solids content of 22.3% (w/w), a pH of 5.8 and according to laser correlation spectroscopy an average particle size of 89 nm.

Emulsion polymer 12

3340 g of an aqueous solution containing 25 g of polymer If-1 and 10 g of potassium peroxidisulphate was prepared under nitrogen atmosphere. This solution was heated at 65° C. with stirring for 2 h and thereupon 159 ml of 1N sodium hydroxide solution and 400 ml of a 10% aqueous solution of HOSTAPON T were added quickly. Thereupon the monomer mixture consisting of 446.5 g of butyl acrylate, 543.5 g of methyl methacrylate and 10 g of acrylic acid was added within 15 min. After the temperature rise of the starting exothermic reaction had been completed, the mixture was stirred at 80° C. for another 2 h, demonomerised at 90° C., then cooled and mixed with a 20% solution of 1000 ppm of phenol in ethanol/water.

The obtained latex had a solids content of 21.7% (w/w), a pH of 6.1 and according to laser correlation spectroscopy an average particle size of 86 nm.

Emulsion polymer 13

3340 g of an aqueous solution containing 25 g of polymer Ia-1 and 10 g of potassium peroxidisulphate was prepared under nitrogen atmosphere. This solution was mixed at once with 150 ml of 1 N sodium hydroxide solution and 400 ml of a 10% aqueous solution of HOSTAPON T. Thereupon the monomer mixture consisting of 446.5 g of butyl acrylate, 543.5 g of methyl methacrylate and 10 g of acrylic acid was added within 15 min. After the temperature rise of the starting exothermic reaction had been completed, the mixture was stirred at 80° C. for another 2 h, demonomerised at 90° C., then cooled and mixed with a 20% solution of 1000 ppm of phenol in ethanol/water.

The obtained latex had a solids content of 19.8% (w/w), a pH of 6.3 and according to laser correlation spectroscopy an average particle size of 74 nm.

Examples of Physical Evaluation in Photographic Materials

Photographic-physical example 1

In this example the dimensional stability of photographic material samples comprising invention latices 1 and 2 is compared to samples comprising control plasticizer polyethylacrylate (C-1).

The photographic material was prepared as follows. A direct positive pure silver bromide emulsion was precipitated by a double jet technique and internally sensitized. The emulsion was then externally fogged using thiourea dioxide as to obtain the desired sensitivity. Finally the emulsion was divided in aliquot portions and different latices were added to each portion according to table 1.

The coating solutions thus prepared were applied to a subbed polyethylene terephtalate base at a silver coverage, expressed as silver nitrate, of 3.18 g/m$^2$, and a gelatin coverage of 2.7 g/m$^2$. A protective layer was applied containing gelatin hardened with formaldehyde at a coverage of 0.7 g/m$^2$.

The sensitivity and gradation were determined as follows. The coated samples were exposed to an UV-white light source (AGFA CDL 2001S) and developed in a conventional Phenidone-hydroquinone developing solution (AGFA G4000), fixed, washed and dried in an AGFA RAPILINE 66A processor. The direct positive sensitivity was determined at density 0.1 above minimum density and expressed as relative log H value, higher figure meaning higher sensitivity. The gradation was measured as the slope of the linear part of the sensitometric curve.

The scratch resistance was measured by scratching the coated samples with a ball point under a gradually increasing load. The value of the scratch resistance corresponds to the load in grams required for cutting through the emulsion layer completely.

The dimensional change during processing is evaluated as follows. Each coated sample was conditioned in an acclimated room for at least 6 hours to a relative humidity of 30 or 60% respectively at 22° C. Two holes with a diameter of 5 mm were punched at a distance of 200 mm in each film sample having dimensions of 35 mm×296 mm. The exact interval between those holes was measured with an inductive half-bridge probe (TESA FMS100) having an accuracy of 1 μm, whereby this distance was called X μm. Subsequently the film material was subjected to processing in an automatic apparatus, a PAKO 26RA the dryer of which was equipped with an air-inlet. The samples were developed at 38° C., fixed at 33° C., rinsed without temperature control, and dried, whereby air of 22° C. and of 30% RH or of 60% RH respectively was provided through the air-inlet and whereby the temperature was raised upto 35° C. in the case of 60% RH, or 55° C. in the case of 30% RH. The distance between the two holes in the film is measured again after an acclimatisation period of 3 hours and is expressed as Y μm. The dimensional stability is calculated as (Y-X).5 and expressed in μm/m.

The results are summarized in tables 1a and 1b.

TABLE 1a

| | latex | | dimensional change | | |
|---|---|---|---|---|---|
| Sample No. | type | g/m$^2$ | 30% RH | 60% RH | scratch res. |
| 1 | — | — | +209 | −71 | 500 |
| 2 | C-1 | 0.66 | +172 | −53 | 1300 |
| 3 | C-1 | 1.40 | +148 | −66 | 850 |
| 4 | C-1 | 2.20 | +132 | −52 | 650 |
| 5 | e.p. 2 | 0.66 | +161 | −41 | >1600 |
| 6 | e.p. 2 | 1.40 | +148 | −48 | 1075 |
| 7 | e.p. 2 | 2.20 | +143 | −57 | 775 |
| 8 | e.p. 1 | 0.66 | +172 | −36 | 1450 |
| 9 | e.p. 1 | 1.40 | +147 | −41 | 1100 |
| 10 | e.p. 1 | 2.20 | +107 | −56 | 825 |

TABLE 1b

| Sample No | latex type | sensitivity | gradation |
|---|---|---|---|
| 1 | — | 1.49 | 4.6 |
| 2 | C-1 | 1.37 | 4.1 |
| 3 | C-1 | 1.34 | 3.8 |
| 4 | C-1 | 1.33 | 3.4 |
| 5 | e.p. 2 | 1.38 | 4.2 |
| 6 | e.p. 2 | 1.33 | 3.7 |
| 7 | e.p. 2 | 1.28 | 3.5 |
| 8 | e.p. 1 | 1.38 | 4.2 |
| 9 | e.p. 1 | 1.34 | 3.9 |
| 10 | e.p. 1 | 1.33 | 3.6 |

The photographic results with the invention latices are similar to those with the control latex. However it is clear from table Ia that the scratch resistance/dimensional change relation is substantially improved when using the invention latices.

Photographic-physical example 2

In this example the physical properties of photographic samples containing control or invention latices were compared at a rather low gelatin coverage.

The silver bromide emulsion was prepared as in example 1. The respective latices were added to the emulsion in an amount corresponding to a coverage of 1.5 g/m$^2$ after coating. The coating solutions were applied to a polyethylene terephtalate base at a coverage of 3.18 Ag/m$^2$ and 1.5 g gelatin/m$^2$. The same protective layer was applied as in example 1.

The results are summarized in table 2.

TABLE 2

| Sample No. | latex type | gradation | scratch resistance | dimensional change 30% RH |
|---|---|---|---|---|
| 1 | C-1 | 4.0 | 140 | +113 |
| 2 | e.p. 3 | 4.0 | 230 | +108 |
| 3 | e.p. 4 | 4.1 | 260 | +132 |
| 4 | e.p. 5 | 4.0 | 250 | +119 |
| 5 | e.p. 7 | 4.3 | 230 | +121 |
| 6 | e.p. 13 | 3.9 | 270 | +129 |

Due to the relative low gelatin coverage the scratch resistance values were lower than in example 1. Again it is clear that the scratch resistance/dimensional change relation was better for the samples containing invention latices.

Photographic-physical example 3

In this example photographic samples are compared in which both the emulsion layer and the protective layer contain control or invention plasticizers.

The silver bromide emulsion was prepared as in example 1. The respective latices were added to the emulsion in an amount corresponding to a coverage of 1.5 g/m$^2$ after coating. The coating solutions were applied to a polyethylene terephtalate base at a coverage of 3.18 Ag/m$^2$ and 1.5 g gelatin/m$^2$. The protective layer was applied containing formaldehyde hardened gelatin at a coverage of 0.7 g/m$^2$ and a latex at a coverage of 1.4 g/m$^2$.

The results are summarized in Table 3.

TABLE 3

| Sample No. | latex type | gradation | scratch resistance | dimensional change 30% RH |
|---|---|---|---|---|
| 1 | C-1 | 4.4 | 160 | +95 |
| 2 | e.p. 3 | 4.5 | 180 | +118 |
| 3 | e.p. 7 | 4.4 | 210 | +115 |
| 4 | e.p. 8 | 4.3 | 190 | +116 |
| 5 | e.p. 13 | 4.4 | 170 | +108 |

Although the results are less pronounciated as in the previous examples it is still clear that the invention latices gave rise to better scratch resistance values for acceptable dimensional stability values.

We claim:

1. Photographic material comprising a support, at least one silver halide emulsion layer, and optionally one or more other hydrophilic gelatinous layer(s), characterized in that at least one of said emulsions or other hydrophilic gelatinous layer(s) contains a polymer latex with an average particle size of less than 500 μm, which is obtained by subjecting to radical emulsion polymerisation one or more radical-polymerisable monomers, whose emulsifier-free homopolymers or copolymers possess a glass transition temperature below 65° C., in the presence of a water-soluble polymer of formula I (I)

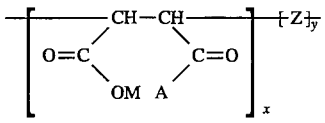

wherein

Z is —$CH_2$—$CR^1R^2$—(I.1), or (I.2)

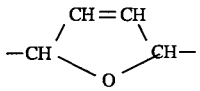

M represents H, Na, K, Li, or $NH_4$, $R^1$ represents H or $CH_3$, $R^2$ represents H, $C_1$–$C_6$ alkyl, aryl, —$(CH_2)_m$—OCO—$R^5$, wherein $R^5$ corresponds to $C_1$–$C_8$ alkyl and m is 0 or 1,

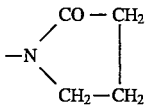

A represents OM, $OR^3$, $NH_2$, $NHR^3$, O—$R^4$—$(SO_3M)_n$ or NH—$R^4$—$(SO_3M)_n$, wherein $R^3$ represents $C_1$–$C_4$ alkyl, $R^4$ represents an aliphatic or aromatic residue of 1 to 10 C atoms, n is 1 or 2, and x,y are chosen in such a way that the weight-average molecular weight of polymer I is comprised between 5,000 to 500,000, and the ratio x:y is comprised between 1:4 and 1:1.

2. Photographic material according to claim 1 wherein $R^2$ is chosen from the group consisting of —$CH_3$, —$C_2H_5$, —$C_4H_9$, —$CH_2C(CH_3)_3$), phenyl and tolyl.

3. Photographic material according to claim 1 wherein $R^4$ is derived from a residue chosen from the group consisting of $C_1$–$C_4$ alkane, benzene, methylbenzene and naphthalene.

4. Photographic material according to claim 1 wherein said radical-polymerisable monomers comprise a mixture of n.-butyl acrylate, methyl methacrylate and acrylic acid.

5. Photographic material according to claim 1 wherein said polymer latex is present in the emulsion layer and/or in the protective layer in a latex/gelatin ratio ranging from 0.2 to 1.

6. Photographic material according to claim 1 wherein said material is a graphic arts contact material.

7. Photographic material according to claim 1 wherein said one or more radical-polymerisable monomers are those whose glass transition temperature of their emulsifier-free homopolymers or copolymers is below 30° C.

* * * * *

UNITED STATES PATENT AND TRADEMARK OFFICE

CERTIFICATE OF CORRECTION

PATENT NO. : 5,478,710

DATED : December 26, 1995

INVENTOR(S) : Muller et al.

It is certified that error appears in the above-indentified patent and that said Letters Patent is hereby corrected as shown below:

The title page, should be deleted to appear as per attached Title Page.

Drawing sheets 1-9 should be deleted.

Signed and Sealed this

Twenty-ninth Day of October 1996

*Attest:*

Bruce Lehman

BRUCE LEHMAN

*Attesting Officer*

*Commissioner of Patents and Trademarks*

United States Patent [19]

Müller et al.

[11] Patent Number: 5,478,710

[45] Date of Patent: Dec. 26, 1995

[54] TYPE OF POLYMER LATEX AND ITS USE AS PLASTICIZER IN A PHOTOGRAPHIC MATERIAL

[75] Inventors: Michael Müller, Bergisch Gladbach, Germany; Daniel M. Timmerman, Mortsel; Guido V. Desie, Herent; Stefaan F. Lingier, Evergem, all of Belgium; Günter Stackmann, Leverkusen, Germany

[73] Assignee: AGFA-Gevaert, N.V., Mortsel, Belgium

[21] Appl. No.: 289,638

[22] Filed: Aug. 12, 1994

[30] Foreign Application Priority Data

Sep. 9, 1993 [DE] Germany ..... 93202629.7

[51] Int. Cl.[6] ..... G03C 1/76

[52] U.S. Cl. ..... 430/536; 430/631; 430/537; 430/627; 430/640; 430/539

[58] Field of Search ..... 430/631, 536, 430/537, 627, 640, 539

[56] References Cited

U.S. PATENT DOCUMENTS

| | | | |
|---|---|---|---|
| 4,151,336 | 4/1979 | Sackmann et al. | 526/15 |
| 4,256,827 | 3/1981 | Noguchi et al. | 430/215 |
| 4,481,319 | 11/1984 | Sackmann et al. | 524/213 |
| 4,714,671 | 12/1987 | Helling et al. | 430/545 |
| 4,931,510 | 6/1990 | Sackmann et al. | 525/302 |
| 5,013,794 | 5/1991 | Sackmann et al. | 525/203 |

FOREIGN PATENT DOCUMENTS

| | | |
|---|---|---|
| 0307778 | 3/1989 | European Pat. Off. |

*Primary Examiner*—Thomas R. Neville
*Attorney, Agent, or Firm*—Breiner & Breiner

[57] ABSTRACT

New types of polymer latices and their use in photographic materials are disclosed. They are obtained by subjecting to radical emulsion polymerisation one or more radical-polymerisable monomers, whose emulsifier-free homopolymers or copolymers possess a glass transition temperature below 65° C., preferably below 30° C., in the presence of a water-soluble polymer of a particular chemical formula.

These new types of latices are preferably used in graphic arts contact materials, e.g. daylight materials. They can be used in relative high amounts thus improving dimensional stability without deteriorating the scratch resistance too strongly.

A preferred radical-polymerisable monomer mixture comprises n.-butyl acrylate, methyl methacrylate and acrylic acid.

7 Claims, No Drawing